US005400749A

United States Patent [19]

Koizumi et al.

[11] Patent Number: 5,400,749

[45] Date of Patent: Mar. 28, 1995

[54] VALVE LIFTER OF VALVE MECHANISM FOR INTERNAL COMBUSTION ENGINE

[75] Inventors: Shin Koizumi; Noriomi Hosaka; Hirokazu Uehara, all of Atsugi, Japan

[73] Assignee: Unisia Jecs Corporation, Atsugi, Japan

[21] Appl. No.: 118,157

[22] Filed: Sep. 8, 1993

[30] Foreign Application Priority Data

Sep. 9, 1992 [JP] Japan ..... 4-069149 U
Feb. 23, 1993 [JP] Japan ..... 5-011710 U

[51] Int. Cl.[6] ..... F01L 1/16
[52] U.S. Cl. ..... 123/90.51; 123/90.52
[58] Field of Search ..... 123/90.48, 90.51, 90.52; 29/888.43

[56] References Cited

U.S. PATENT DOCUMENTS 2,187,661 1/1940 Lochrane ..... 29/888.43
5,251,587 10/1993 Mori ..... 123/90.51
5,269,268 12/1993 Hara ..... 123/90.51
5,284,112 2/1994 Takehara et al. ..... 123/90.51

FOREIGN PATENT DOCUMENTS 165508 9/1983 Japan ..... 123/90.51
63-147907 6/1988 Japan .

*Primary Examiner*—Dolinar Andrew M.
*Assistant Examiner*—Weilun Lo
*Attorney, Agent, or Firm*—Bachman & LaPointe

[57] ABSTRACT

A valve lifter of a valve mechanism for an internal combustion engine is provided with a crown-shaped valve lifter body which has a center plate with a recess. A fixing projection is integrally formed with the center plate and is formed along a side wall which defines the recess. An inner shim of a disc shape has a plurality of grooves to which the fixing projection is filled by caulking the fixing projection for fixedly connecting the inner shim with the valve lifter body. Therefore, the inner shim is easily and securely assembled in the recess of the valve lifter body so as not to generate the looseness between the inner shim and the valve lifter body while the assemble performance is improved.

6 Claims, 6 Drawing Sheets

VALVE LIFTER OF VALVE MECHANISM FOR INTERNAL COMBUSTION ENGINE

BACKGROUND OF THE INVENTION

1. Field of the Invention

The present invention relates to improvements in a valve lifter of a valve mechanism for an internal combustion engine.

2. Description of the Prior Art

Japanese Patent Provisional Publication No. 63-147907 discloses a typical valve lifter of a valve mechanism for an internal combustion engine. As shown in FIGS. 8A and 8B, such a valve lifter has a valve lifter body 20 which has a bottom portion 20*a* and a recess. 21. An inner shim 23 is embedded in the recess 21 and is in contact with a valve stem 22. The inner shim 23 is formed such that a circular plate is cut away at two opposite segment portions as shown in FIG. 8B. Accordingly, the periphery of the inner shim 23 is formed by a pair of arc portions and a pair of straight portions which are alternatively arranged as shown in FIG. 8B. Each of corners 23*a* of the inner shim 23 is a connecting point of the are portion and the straight portion. On the other hand, a caulking portion 25, which is of a part of a side wall defining the recess 21, is deformed so as to partly fill up the recess 21. Accordingly, projecting portions 26 of the valve lifter body 20 are engaged-with the corners 23*a* of the inner shim 23, respectively as shown in FIG. 8B. That is, each corner 23*a* is embedded in the caulking portion 25. Therefore, the inner shim 23 is fixed by the caulking portions 25 and the recess 21.

However, in the thus conventional valve lifter for a valve mechanism since the valve lifter body 20 receives a rotating force owing to the rotation of a cam 28 above the cylinder bore 27, the inner shim 23 also receives a rotating force at a portion with which the valve stem 22 is in contact. This force generates a concentration of stress at the projection portions 26 and deforms the projection portions 26 as a permanent set in fatigue. This permanent set of the projection portions 26 invites a rotation of the inner shim 23. Further, in almost all cases the valve lifter body 20 is made of aluminum alloy and the inner shim 23 is made of ferroalloy. Accordingly, due to the difference of linear expansion coefficient, the fixing between the inner shim 23 and the recess 21 is loosened to generate backlash or looseness.

SUMMARY OF THE INVENTION

It is an object of the present invention to provide an improved valve lifter which improves a productivity and a durability thereof.

A valve lifter according to the present invention is of a valve mechanism for an internal combustion engine. The valve lifter comprises a valve lifter body which has a cylinder and a center plate. The center plate is connected to the cylinder and has a recess at one side thereof. A fixing projection is integrally formed with the valve lifter body and is formed along a side wall which defines the recess of the center plate. An inner shim of a disc shape has a plurality of grooves to which the fixing projection is fixed by caulking said fixing projection for fixedly connecting said inner shim with said valve lifter body.

With this arrangement, it becomes possible to implement the caulking with a small road as compared with the conventional valve lifter. Furthermore, the caulking is implemented such that the fixing projection is in contact with the outer peripheral surface of the inner shim and such that the side wall of the recess is in contact with the side surface of the inner shim. Therefore, the inner shim is easily and securely assembled in the recess of the valve lifter body so as not to generate the looseness between the inner shim and the valve lifter body while the assemble performance is improved. This improves the durability of the valve lifter without losing the adjust ability of the valve clearance.

BRIEF DESCRIPTION OF THE DRAWINGS

In the drawings, like reference numerals designate like parts and like elements throughout all figures, in which:

FIG. 4*b* is a cross-sectional view which shows an inner shim fixing structure which is accomplished by means of the method of

FIG. 4A;

DETAILED DESCRIPTION OF THE INVENTION

Referring to FIGS. 1A, 1B, 1C, 2A, 2B, 3, 4A and 4B, there is shown a first embodiment of a valve lifter V of a valve mechanism for an internal combustion engine.

Figure 1A:
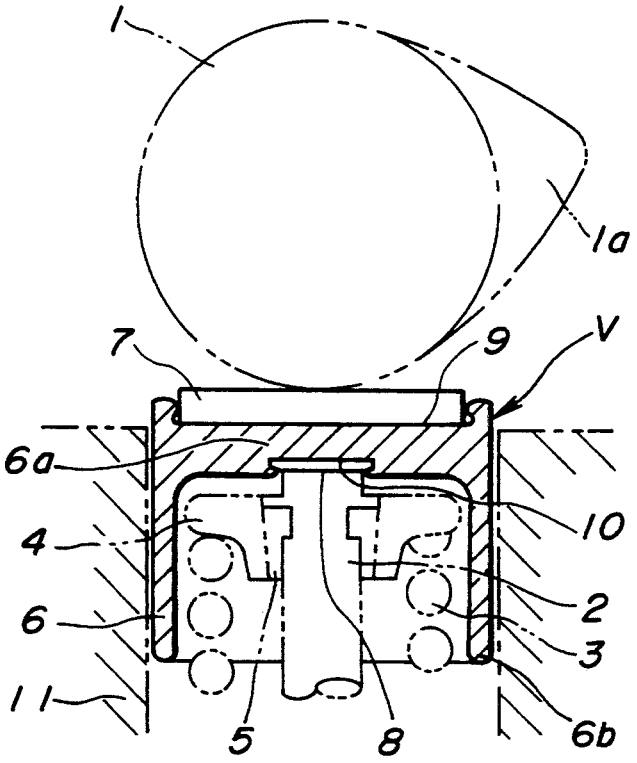
FIG. 1A is a cross-sectional view of a first embodiment of a valve lifter for a valve system according to the present invention.

As shown in FIG. 1A, the valve lifter V is vertically movably disposed in a cylinder bore 11 of the internal combustion engine. The upper surface of the valve lifter V is in contact with a cam 1*a* of a camshaft 1 and a lower portion is pushed by a valve stem 2. The valve lifter V comprises a valve lifter body 6 which is made of aluminum alloy and formed in a crown shape. The valve lifter body 6 has a center plate portion 6*a* and a cylinder portion 6*b* which are integral with each other. An outer shim 7 made of ferroalloy is fixed to a recess 9 formed at the upper surface of the center plate portion 6a and receives a vertically moving force of the cam 1a. An inner shim 8 of a disc shape is fixed in a recess 10 formed at a back surface of the center plate portion 6a and transmits the vertical movement to the valve stem 2. A valve spring 3 is connected to the valve stem 2 through a retainer 4 such that the valve stem 2 always pushes the valve lifter V and the cam 1a. Therefore, the valve stem 2 is vertically moved in correspond to the vertical movement transformed from the rotating movement of the cam 1a.

Figure 1B:
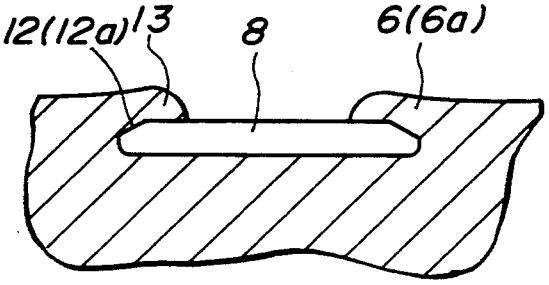
FIG. 1B is a partially enlarged cross-sectional view of FIG. 1A and shows a fixed structure of an inner shim of the first embodiment.
Figure 1C:
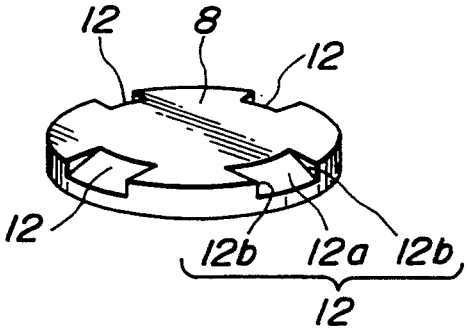
FIG. 1C is a perspective view of the inner shim of the first embodiment.

As shown in FIG. 1C, the inner shim 8 has a plurality of grooves 12 each of which is defined by an inclined bottom surface 12a and two side surfaces 12b. The grooves 12 are formed so as to cut away a part of the edge defined by the upper surface and a peripheral cylindrical surface of the inner shim 8. The inner shim 12 is engaged with a fixing projection 13 of a ring shape in such a manner that the fixing projection 13 is caulked by means of a riveting machine 14. The riveting machine 14 is provided with a main body 14a which is vertically moved and simultaneously rotated relative the vertical axis. A push rod 14b is inclinedly disposed relative to a vertical center axis of the main body 14a and connected to the main body 14a. A push surface 14c is formed at a bottom surface of the push rod 14b. Accordingly, when an assembly operation of the inner shim 8 to the valve lifter body 6 is implemented, the inner shim 8 is insulated in the recess 10, and the fixing projection 13 is caulked toward the inner shim 8 by means of the riveting machine 14.

The caulking of the fixing projection 13 is implemented by the following manner: First, the main body 14a of the riveting machine 14 is positioned so as to be coaxial with the valve lifter body 6 above the inner shim 8. Next, the push rod 14b is rotated while being vertically moved downwardly. The push surface 14c of the push rod 14b then pushes on a tip end of the fixing projection 13 from outer to inner until the fixing projection 13 is deformed and partially covers the peripheral portion of the inner shim 8.

Figure 2A:
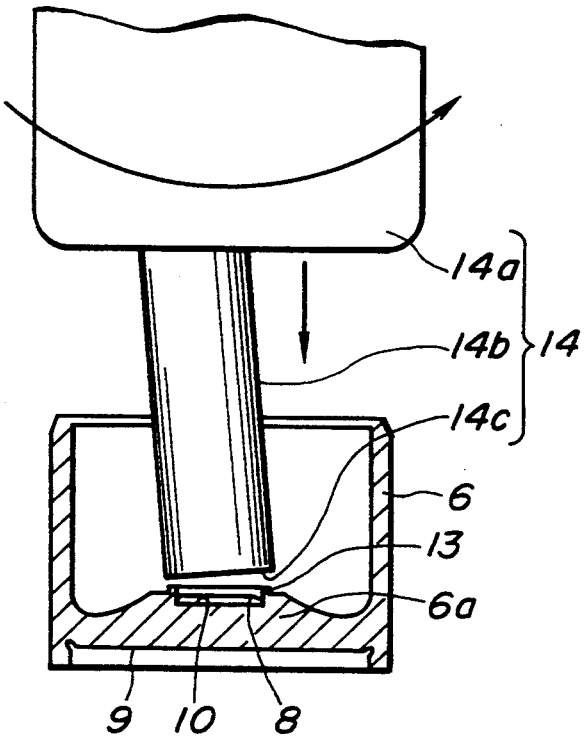
FIG. 2A is an explanatory cross-sectional view which shows a caulking method for caulking the inner shim.
Figure 2B:
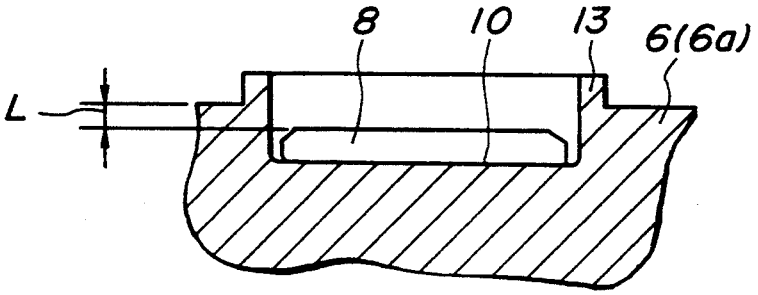
FIG. 2B is a partially enlarged cross-sectional view of FIG. 2A.

Since the fixing projection 13 is formed at the side wall portion of the recess 10 and deformed toward the inner portion of the recess 10 during the caulking operation, a necessary load for the caulking of the fixing projection 13 becomes small as compared with the case in that the fixing projection 13 is not provided as in the conventional case. Furthermore, the height difference between the back surface of the center plate portion 6a and the surface of the inner shim 8 becomes small. A clearance between the inner shim 8 and the side wall portion of the recess 10 is filled with a part of the center plate portion 6a when the caulking is implemented. Further, since the grooves 12 are formed in the inner shim 8, the grooves 12 are also filled with the part of the center plate portion 6a. Accordingly, the outer periphery of the inner shim 8 is in contact with the fixing projection 13, and the cylindrical periphery of the inner shim 8 is in contact with the side wall portion, as shown in FIG. 1B. Furthermore, since the inner shim 8 is provided with the cutaway grooves 12, the fixing projection 13 is fixedly connected to the side walls 12b of the grooves 12 so as not to move vertically and rotationally. In this case, the height difference L, which is the difference in level between the center plate portion 6a of the valve lifter body 6 and the surface of the inner shim 8 as shown in FIG. 2B, is determined at a predetermined value such that the fixing projection 13 properly fills the grooves 12 and covers the outer periphery of the inner shim 8.

Figure 3:
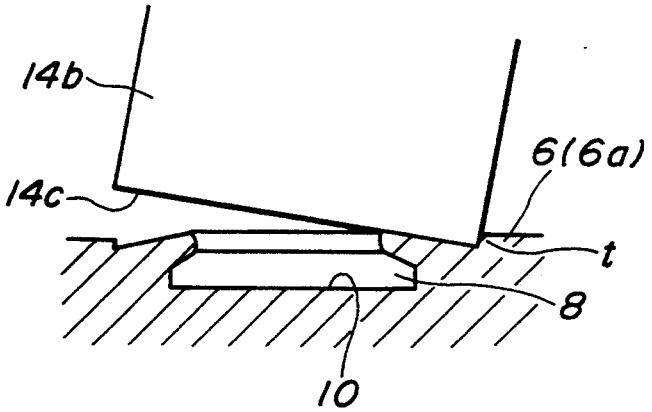
FIG. 3 is a cross-sectional view through which trouble in the caulking method is explained.

It is desirable that the diameter of the push rod 14b is set such that the push surface 14c of the riveting machine 14 does not strike the back surface of the center plate 6a even if the push surface 14c pushes the fixing projection 13. However, if the diameter of the push rod 14b is formed further larger, it is apprehended that the outer periphery of the push surface 14c is thrust into the back surface of the center plate portion 6a and generates burrs t on the back surface of the center plate portion 6a as shown in FIG. 3.

Figure 4A:
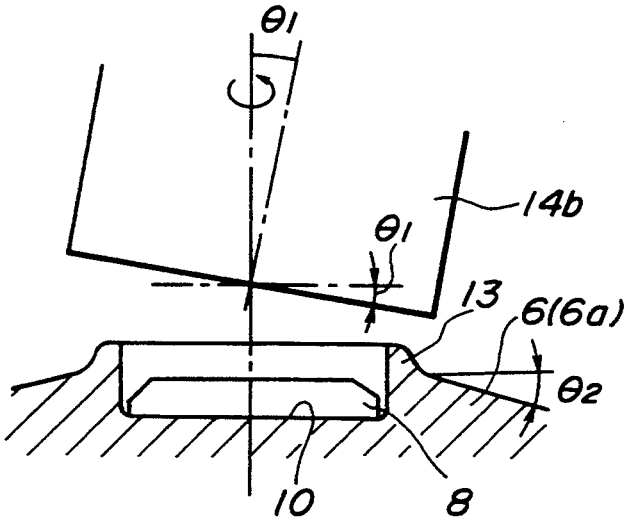
FIG. 4A is a cross-sectional view showing a counterplan relative to the trouble of FIG. 3.
Figure 4B:
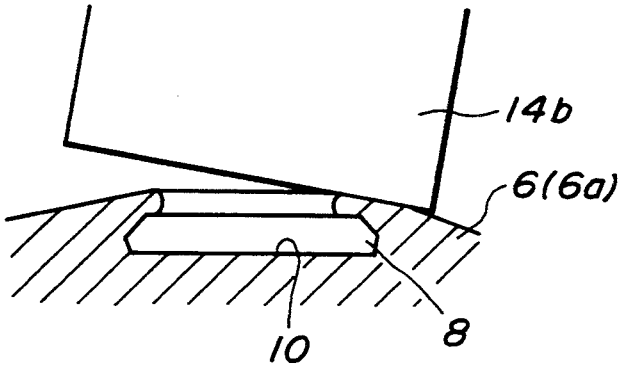

In contrast, it is preferable to form the fixing projection 13 and a back surface of the center plate portion 6a as shown in FIG. 4A, that is, to form the surrounding portion of the fixing projection 13 so as to have a taper angle $\theta 2$ which is larger than the inclined angle $\theta 1$ of the push rod 14b relative to the center axis of the valve lifter body 20. With this arrangement, the back surface of the center plate portion 6a is not in contact with the push rod 14b and therefore the caulking can be preferably implemented without the generation of burrs, as shown in FIG. 4B. Further, it is possible to decrease the thickness of the center o plate portion 6a which keeping the strength of the center plate portion 6a.

Figure 5:
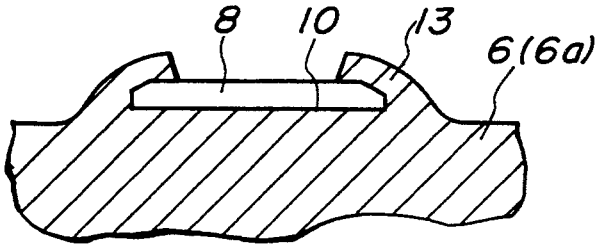
FIG. 5 is a cross-sectional view which shows another o example of the inner shim fixing structure.
Figure 6A:
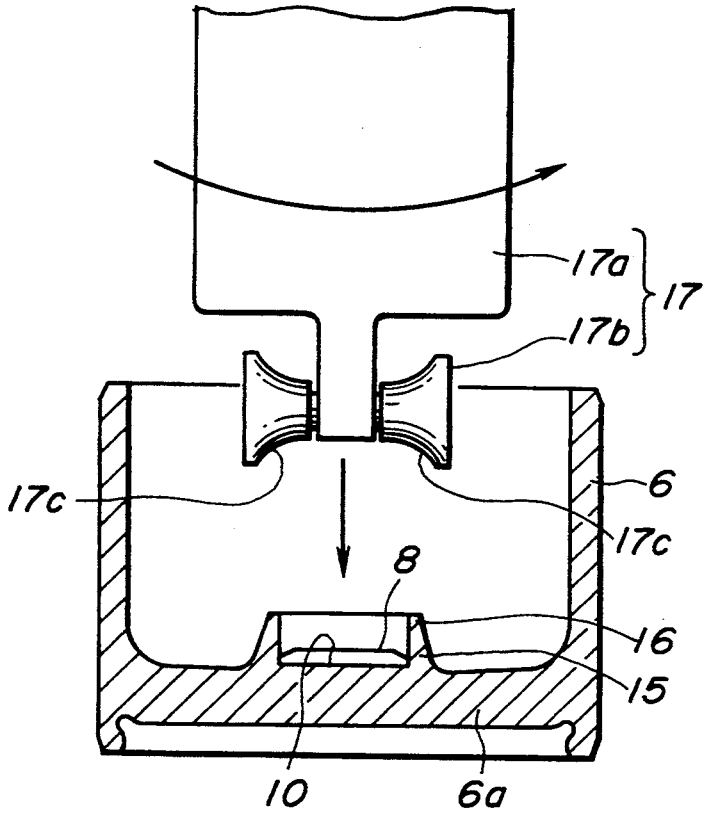
FIG. 6A is a cross-sectional view which shows a condition before the inner shim caulking method of FIG. 5 is implemented.
Figure 6B:
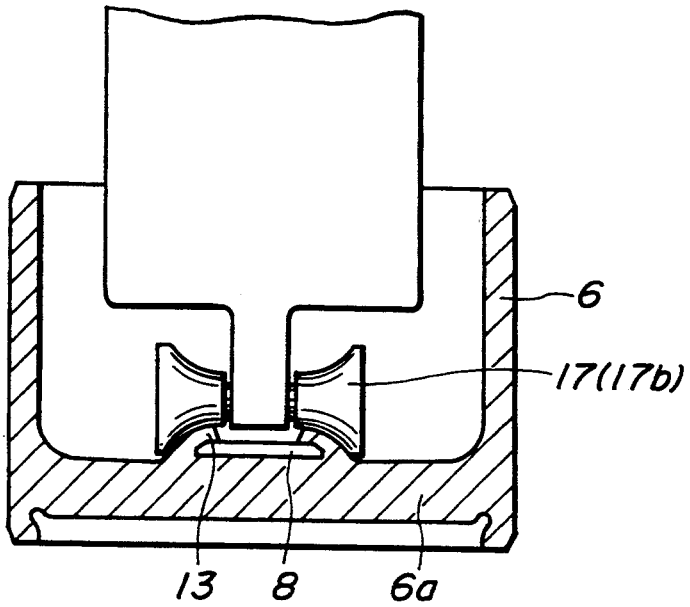
FIG. 6B is a cross-sectional view which shows a condition after the inner shim fixing method of FIG. 5 is implemented.
Figure 8A:
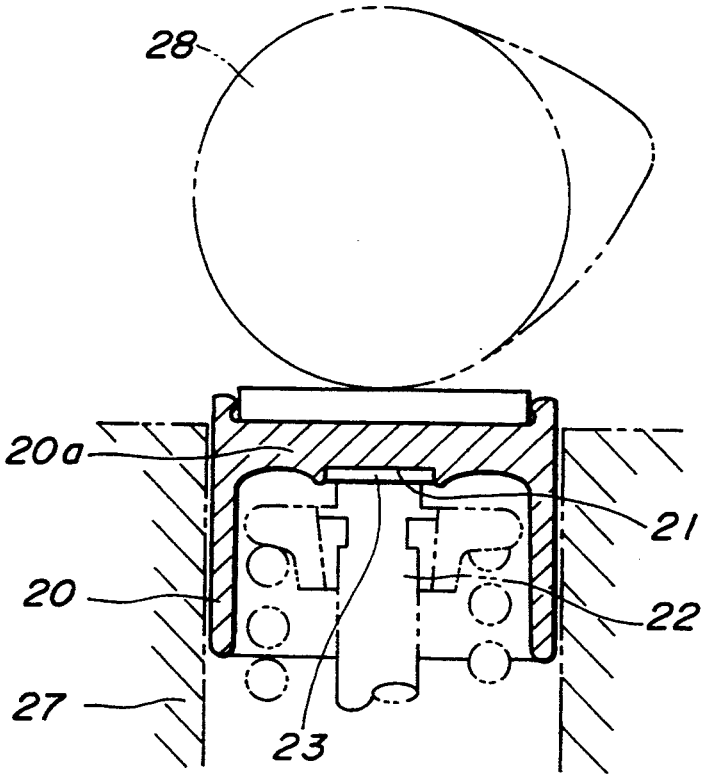
FIG.8A (PRIOR ART)
FIG. 8A is a cross-sectional view of a conventional valve lifter for a valve system.
Figure 8B:
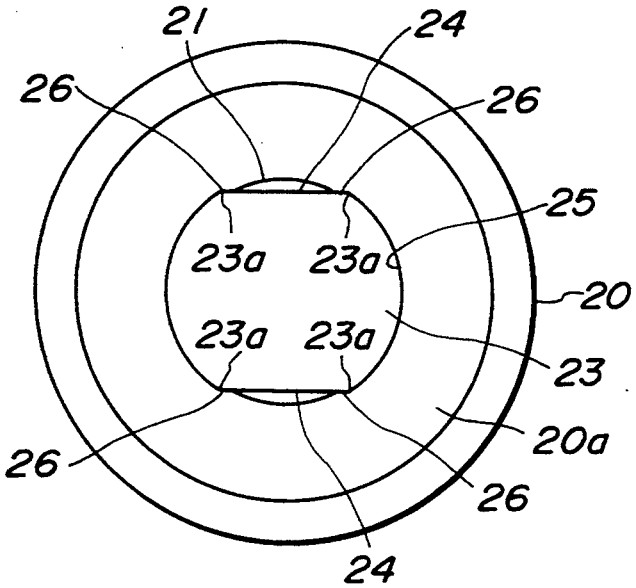
FIG.8B (PRIOR ART)
FIG. 8B is an partially enlarged plan view of FIG. 8A and shows a fixed structure of an inner shim of the conventional valve lifter.

Referring to FIG. 5, 6A and 6B, there is shown a second embodiment of the valve lifter V of the valve mechanism for an internal combustion engine according to the present invention.

The second embodiment is generally similar to the first embodiment except that a ring-shaped projection 15 and a fixing projection 16 are formed on the back surface of the center plate portion so as to form a recess 10 as shown in FIG. 6A. Outer peripheries of the projections 15 and 16 are tapered such that their diameters are gradually decreased toward a tip end of the fixing projection 16. The caulking of the projections 15 and 16 is implemented by a riveting machine 17 so as to fix the fixing projection 16 to the outer peripheral surface of the inner shim 8. The outer peripheral surface of the fixing projection 16 is formed so as to gradually decrease the diameter toward the tip end portion thereof as shown in FIG. 6A.

The riveting machine 17 comprises a main body 17a which is rotated and vertically moved and a hourglass-shaped roller 17b which is rotatably connected to a tip end portion of the main body 17a.

The caulking of the fixing projection 16 is implemented by the following manner: First, the main body 17a of the riveting machine 17 is disposed to be coaxial with the valve lifter body 20. Next, the hourglass-shaped roller 17b is rotated while being vertically moved. Curving surfaces 17c of the hourglass-shaped roller 17b then pushes on a tip end of the fixing projection 16 from outer to inner in the diametrical direction until the fixing projection 16 is deformed and partially covers the peripheral portion of the inner shim 8.

Since the fixing projection 16 is formed along the side wall portion of the recess 10 and deformed toward the inner portion of the recess 10, a necessary load for the caulking of the fixing projection 16 becomes small as compared with the case in that the side wall portion of the recess 10 is caulked without the deformation of the center plate portion 6a of the valve lifter body 6 and the like. With this caulking of the fixing projection 16, a clearance between the surface of the inner shim 8 and the side wall portion of the recess 10 is filled with a part of the center plate portion 6a when the caulking is implemented. Further, since the grooves 12 are formed in the inner shim 8, the grooves 12 are also filled with the part of the fixing projection 16.

Accordingly, the outer periphery of the inner shim 8 is in contact with the fixing projection 16, and the side periphery of the inner shim 8 is in contact with the side wall portion, as shown in FIG. 5. Furthermore, when the inner shim 8 is provided with the cutaway grooves 12, the fixing projection 13 is fixedly connected to the side walls 12*b* of the grooves 12. In this case, the height difference L, which is the difference in level between the center plate portion 6*a* of the valve lifter body 6 and the surface of the inner shim 8 as shown in FIG. 2B, is determined at a predetermined value.

Figure 7:
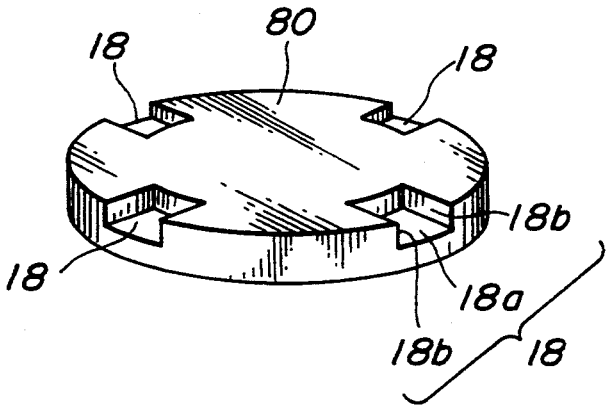
FIG. 7 is a perspective view of another embodiment of the inner shim.

FIG. 7 shows an inner shim 80 which is applied to a third embodiment of the valve lifter V for an internal combustion engine according to the present invention. The third embodiment is generally similar to the second embodiment except that the inner shim 80 is instead of the inner shim 8. The inner shim 80 has a plurality of grooves 18 each of which has a bottom surface 18*a* and a side wall 18*b*. The bottom surface 18 is parallel with both plane surfaces of the inner shim 80. That is, the grooves 18 are recesses which are opened upwardly and outwardly. Accordingly, when the inner shim 80 is fixed disposed in the recess 10 by means of the caulking operation, the inner shim 80 is fixed secured so as not to be moved vertically and rotationally due to the grooves 18.

With the thus arranged embodiments of the valve lifter V, the inner shim 8, 80 is engagingly positioned in the recess 10 which is formed at the back surface of the center plate portion 6*a* of the crown-shaped valve lifter body. Further, the inner shim 8, 80 is caulked by the fixing projection 13, 16 formed along the side wall portion of the recess 10 by means of the riveting machine 14, 17. Accordingly, it becomes possible to implement the caulking with a small road as compared with the conventional valve lifter. Furthermore, the caulking is implemented such that the fixing projection 13, 16 is in contact with the outer peripheral surface of the inner shim 8, 80 and such that the side wall of the recess 10 is in contact with the side surface of the inner shim 8, 80, without the deformation of the other part of the center plate portion 6*a*. Therefore, the inner shim 8, 80 is easily and securely assembled in the recess of the valve lifter body 6 so as not to generate the looseness between the inner shim 8, 80 and the valve lifter body 6 while the assemble performance is improved. This improves the durability of the valve lifter V without losing the adjust ability of the valve clearance.

In addition, since a part of the back surface of the center plate portion 6*a*, which surrounds the fixing projection, is formed such that the part is tapered to be larger in angle than the inclined angle of the push rod, the valve lifter V is formed so as not to generate burrs on the back surface of the center plate portion 6*a*. This improves the quality of the products. Furthermore, since the back surface of the center plate portion is formed so as to be bulged at a center portion of the back surface, the strength of the valve lifter body 6 is kept even if the thickness of the center plate portion 6*a* is decreased in some degree.

What is claimed is:

1. A valve lifter of a valve mechanism for an internal combustion engine, comprising:

a valve lifter body having a cylinder and a center plate connected to the cylinder, the center plate having a recess at one side thereof;

a fixing projection integrally formed with said valve lifter body, said fixing projection formed along a side wall which defines the recess of said center plate; and an inner shim of a disc shape having a plurality of grooves on a surface in contact with a valve stem of the valve mechanism, said inner shim being fixed with said valve lifter body through said fixing projection, each of the grooves of said inner shim being formed at a peripheral portion of the disc surface of said inner shim and being defined by a bottom surface and two side walls.

2. A valve lifter as claimed in claim 1, wherein the center plate is integrally connected to the cylinder so as to close one of two openings.

3. A valve lifter as claimed in claim 1, wherein the grooves includes four cutaways.

4. A valve lifter as claimed in claim 1, wherein the grooves of said inner shim are filled with said fixing projection for fixedly connecting said inner shim with said valve lifter body.

5. A valve lifter of a valve mechanism for an internal combustion engine, comprising:

a valve lifter body having a cylinder and a center plate connected to the cylinder, the center plate having a recess at one side thereof;

a fixing projection integrally formed with said valve lifter body, said fixing projection formed along a side wall which defines the recess of the center plate; and a disc-shaped inner shim having a top surface and a bottom surface connected by a side wall surface, one of said top surface and bottom surface having a plurality of grooves for fixing said inner shim in the recess of the valve lifter body, each of the grooves of said inner shim being formed with a bottom surface and two side walls.

6. A valve lifter as claimed in claim 5, wherein the fixing projection is fixedly connected to the side walls of the grooves so as to prohibit rotational and vertical movement of the inner shim in the recess.

* * * * *